US006767636B2

(12) United States Patent
Takai et al.

(10) Patent No.: US 6,767,636 B2
(45) Date of Patent: Jul. 27, 2004

(54) THERMAL SPRAY RARE EARTH OXIDE PARTICLES, SPRAYED COMPONENTS, AND CORROSION RESISTANT COMPONENTS

(75) Inventors: Yasushi Takai, Takefu (JP); Takao Maeda, Takefu (JP); Toshihiko Tsukatani, Takefu (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 148 days.

(21) Appl. No.: 10/101,612

(22) Filed: Mar. 21, 2002

(65) Prior Publication Data

US 2002/0192429 A1 Dec. 19, 2002

(30) Foreign Application Priority Data

Mar. 21, 2001 (JP) ..... 2001-080154

(51) Int. Cl.[7] ..... B32B 5/16

(52) U.S. Cl. ..... 428/402; 428/328; 423/263; 423/592; 427/453

(58) Field of Search ..... 428/402, 328; 423/263, 592; 427/453

(56) References Cited

U.S. PATENT DOCUMENTS

| | | | | |
|---|---|---|---|---|
| 4,590,090 | A | 5/1986 | Siemers et al. | |
| 5,332,558 | A | 7/1994 | Kaneyoshi et al. | |
| 5,545,386 | A | 8/1996 | Kaneyoshi et al. | |
| 6,576,354 | B2 * | 6/2003 | Tsukatani et al. | 428/702 |
| 6,596,397 | B2 * | 7/2003 | Kaneyoshi et al. | 428/402 |

FOREIGN PATENT DOCUMENTS

| | | |
|---|---|---|
| EP | 0 548 434 | 6/1993 |
| EP | 1 167 565 | 1/2002 |

* cited by examiner

*Primary Examiner*—Ieszek B Kiliman
(74) *Attorney, Agent, or Firm*—Birch, Stewart, Kolasch & Birch, LLP

(57) ABSTRACT

Rare earth oxide particles having an average particle diameter of 3–20 $\mu$m, a dispersion index of up to 0.4, and an aspect ratio of up to 2 are suitable for thermal spraying. Despite their high melting point, the rare earth oxide particles of high purity can form an adherent coating by thermal spraying.

10 Claims, No Drawings

THERMAL SPRAY RARE EARTH OXIDE PARTICLES, SPRAYED COMPONENTS, AND CORROSION RESISTANT COMPONENTS

This invention relates to rare earth oxide particles for thermal spraying, a sprayed component having a coating of the rare earth oxide particles, and a corrosion resistant component comprising the sprayed component.

BACKGROUND OF THE INVENTION

It is a common practice in the art to thermally spray metal oxide particles to metal, ceramic and other substrates to form a coating thereof for imparting heat resistance, abrasion resistance and corrosion resistance.

Conventional methods for preparing particles suitable for thermal spray coating include (1) a method of producing a fused and ground powder by melting a starting material in an electric furnace, cooling the melt for solidification, and grinding the solid in a grinding machine into particles, followed by classification for particle size adjustment; (2) a method for producing a sintered and ground powder by firing a raw material, and grinding the sintered material in a grinding machine into particles, followed by classification for particle size adjustment; and (3) a method for producing a granulated powder by adding a raw material powder to an organic binder to form a slurry, atomizing the slurry through a spray drying granulator, and firing the granules, optionally followed by classification for particle size adjustment.

The thermal spraying particles have to meet the requirements that (i) they can be consistently fed at a quantitative rate to the plasma or flame during spraying, (ii) their shape remains undisrupted during the feed and spraying (in plasma or flame), and (iii) they are fully melted during spraying (in plasma or flame). These requirements are quantitatively expressed by more than ten physical parameters of particles.

Since the thermal spraying particles are fed to the spray gun through a narrow flowpath such as a transportation tube, whether they can be consistently fed at a quantitative rate is largely affected by the fluidity thereof among other physical parameters. However, the fused or sintered and ground powder resulting from method (1) or (2) has irregular shapes and a broad particle size distribution so that the friction between particles during transportation entails formation of finer particles. Additionally, the powder has a large angle of repose and poor fluidity so that the transportation tube or spray gun can be clogged, preventing continuous thermal spraying operation.

Developed as a solution to these problems of the ground powders was the granulated powder obtained by method (3), that is, having the advantage of smooth fluidity due to the spherical or nearly spherical shape of particles. The strength of the granulated powder tends to vary over a wide range because it depends on the particle size distribution of a raw material powder and the firing conditions. Particles with a low strength will readily collapse during the feed to the spray gun and during the spraying (in the flame or plasma).

In the thermal spraying of metal oxide particles, the particles must be completely melted in the flame or plasma in order to form a sprayed coating having a high bond strength. Particularly when particles of rare earth oxide are used for thermal spraying, because of their high melting point, they must have a smaller average particle size so that they may be completely melted.

In the event where granulated powder is prepared using a spray drying granulator, however, an average particle diameter of less than 20 $\mu$m is difficult to accomplish. In the event of the fused or sintered and ground powder resulting from method (1) or (2), a spray material having a small average particle diameter is obtainable owing to grinding in a mill, which can cause contamination. When particles are prepared in a conventional way, it is difficult to avoid the introduction of impurities at a level of several ten ppm.

As mentioned above, the fused/ground powder, sintered/ground powder and granulated powder discussed above individually have advantages and disadvantages and are not necessarily optimum as the spray material of rare earth oxide. Additionally, the powders of these three types all suffer contamination from the grinding, granulating and classifying steps, which is deemed problematic from the high purity standpoint.

Specifically, the fused/ground powder, sintered/ground powder or granulated powder having passed the grinding or granulating and classifying steps contains impurities such as iron group elements, alkali metal elements and alkaline earth metal elements, typically in a content of more than 20 ppm. A sprayed component having a coating obtained by spraying any of these powders is susceptible to corrosion at impurity sites in the coating, failing to provide satisfactory durability.

SUMMARY OF THE INVENTION

An object of the invention is to provide thermal spray rare earth oxide particles of high purity which can be thermally sprayed to form an adherent coating despite the high melting point of the rare earth oxide.

Another object of the invention is to provide a sprayed component having the particles spray coated on a substrate surface.

A further object of the invention is to provide a corrosion resistant component using the sprayed component.

The invention addresses rare earth oxide particles for thermal spraying. We have found that by controlling the average particle diameter, dispersion index and aspect ratio to specific ranges, and optionally, controlling the surface area, bulk density, crystallite size and impurity content to specific ranges, the rare earth oxide particles are improved in fluidity and given so high density and strength that the particles are completely melted rather than being collapsed during thermal spraying. A coating obtained by thermally spraying the particles is smooth and pure as compared with conventional sprayed coatings, and offers better adhesion and corrosion resistance.

In a first aspect, the invention provides rare earth oxide particles for thermal spraying having an average particle diameter of 3 to 20 $\mu$m, a dispersion index of up to 0.4, and an aspect ratio of up to 2. Preferably, the particles have a specific surface area of 0.3 to 1.0 $m^2/g$, and a bulk density of 30 to 50% of true density. Preferably, crystallites in the particles have a size of at least 25 nm. The total amount of iron group elements, alkali metal elements and alkaline earth metal elements in the particles is preferably limited to 20 ppm or less.

In a second aspect, the invention provides a sprayed component comprising a substrate having a surface and a coating of the rare earth oxide particles thermally sprayed on the substrate surface. The substrate is typically made of a metal material selected from the group consisting of Al, Fe, Si, Cr, Zn, Zr, Ni and alloys thereof, or a ceramic or glass material. The coating preferably has a surface roughness of up to 60 $\mu$m.

A corrosion resistant component comprising the sprayed component is also contemplated herein.

DESCRIPTION OF THE PREFERRED EMBODIMENTS

In the invention, particles for thermal spraying are formed of a rare earth oxide. As used herein, the term "rare earth" encompasses rare earth elements of Group 3A in the Periodic Table inclusive of yttrium (Y). The rare earth elements may be used alone or in admixture. It is understood that compound oxides of the rare earth combined with at least one metal selected from Al, Si, Zr, In, etc. are also useful for the inventive particles.

The rare earth oxide particles should have an average particle diameter of 3 to 20 $\mu$m, and especially 7 to 16 $\mu$m. If the average particle diameter is less than 3 $\mu$m, fine particles may evaporate or scatter in the plasma flame during spraying, resulting in a corresponding loss. If the average particle diameter exceeds 20 $\mu$m, some particles may remain unmelted (not completely melted) in the plasma flame during the spraying step and thus form non-fused particles, resulting in a low bond strength.

It is noted that particles have a particle size distribution as measured by a laser diffraction analyzer in which a particle diameter D90, D50 and D10 corresponds to 90%, 50% and 10% by weight accumulation, respectively. As used herein, the "average particle diameter" is a diameter D50 corresponding to 50 wt % accumulation.

The rare earth oxide particles have a spherical or generally spherical shape and a narrow particle size distribution. Specifically, the particles should have a dispersion index of up to 0.4 and an aspect ratio of up to 2. The dispersion index is defined as:

$$\text{Dispersion index}=(D90-D10)/(D90+D10).$$

A dispersion index in excess of 0.4 indicates a broad particle size distribution and leads to a disturbance to fluidity so that the nozzle to which the powder is fed may be clogged. Preferably the dispersion index is up to 0.3.

As used herein, the "aspect ratio" is defined as the ratio of major diameter to minor diameter of a particle, that is an index indicating whether the particle shape is approximate to sphere. An aspect ratio of more than 2 indicates that particles have a shape dissimilar from sphere, leading to disturbed flow. The lower limit of the aspect ratio is, though not critical, preferably close to 1.

In a preferred embodiment, the thermal spray particles of rare earth oxide have a specific surface area of 0.3 to 1.0 $m^2/g$, and more preferably 0.3 to 0.8 $m^2/g$, as measured by the BET method. A surface area in excess of 1.0 $m^2/g$ may lead to deteriorated surface smoothness and poor fluidity. Note that in many cases, rare earth oxide particles having an average particle diameter of 3 to 20 $\mu$m generally have a specific surface area of at least 0.3 $m^2/g$.

In a further preferred embodiment, the particles have a bulk density of 30 to 50% of true density. A bulk density of less than 30% of true density indicates that particles may be less dense and hence, weak enough to collapse upon spraying. Even when particles are very dense, few have a bulk density of more than 50% of true density.

It is generally believed that single crystal particles are most dense, and that polycrystalline particles are more dense as single crystal grains constituting each particle have a larger grain size. The single crystal grains constituting each particle are generally known as crystallites. In the thermal spray particles of rare earth oxide according to the invention, the crystallites preferably have a size of at least 25 nm, and more preferably at least 50 nm. When the crystallite size is less than 25 nm, polycrystalline particles with such a small single crystal grain size are not regarded dense in many cases. Note that the crystallite size is determined by effecting x-ray diffraction analysis and calculating according to Wilson method. According to Wilson method, the crystallite size is up to 100 nm at maximum.

When it is desired that a coating formed on a component by spraying the particles impart satisfactory corrosion resistance to the coated component. The thermal spray particles of rare earth oxide should preferably have a limited impurity content. Specifically, the total content of iron group elements (Fe, Ni, Co, etc.), alkali metal elements (Na, K, etc.) and alkaline earth metal elements (Mg, Ca, etc.) in the particles should preferably be up to 20 ppm, more preferably up to 15 ppm, and especially up to 5 ppm. The lower the total content of these metal elements, the better are the results. In most cases, the lower limit is about 0.1 ppm. It is noted that the content of iron group elements, alkali metal elements or alkaline earth metal elements is measured by inductively coupled plasma (ICP) emission spectrometry after acidolysis of the particles.

The thermal spray particles of rare earth oxide are preferably prepared by the following process although the invention is not limited thereto.

First, an aqueous rare earth solution (i.e., an aqueous solution of a water-soluble rare earth salt such as chloride, nitrate or sulfate) is mixed with an aqueous oxalic acid solution in such amounts that 1.5 to 2.0 mol of oxalate ions are available relative to the total of rare earth elements. The mixed solution is cooled at a low temperature of −5° C. to 20° C. whereupon crystals precipitate. That is, rare earth oxalate particles having a nearly spherical shape and an average particle diameter of 3 to 20 $\mu$m are obtained. They are dried at −20° C. to 20° C. by a freeze dryer or the like, and fired in air at a temperature of 800 to 1,700° C., preferably 1,200 to 1,600° C., for about 1 to 6 hours, preferably about 2 to 4 hours, obtaining rare earth oxide particles for thermal spraying. If the total amount of rare earth elements is too large (or if the oxalate ion amount is less than 1.5 mol), then the rare earth elements do not completely precipitate, leading to lower yields. If the total amount of rare earth elements is too small (or if the oxalate ion amount is more than 2.0 mol), then use of excess oxalic acid is uneconomical. When the amount of oxalate ions relative to the total of rare earth elements is within the above-defined range, spherical particles of quality are produced in good yields.

The above process does not involve a granulating step and/or a grinding step and thus minimizes the introduction of contaminants from auxiliary materials and the process equipment. As a consequence, spherical particles of high purity are readily produced in which the total content of iron group elements (Fe, Ni, Co, etc.), alkali metal elements (Na, K, etc.) and alkaline earth metal elements (Mg, Ca, etc.) is up to 20 ppm.

As described above, the spray particles of the invention are free fluidic, can be consistently and continuously fed through a transportation tube or the like without clogging thereof, have a high density and strength enough to withstand collapse in the plasma flame during spraying. In addition, the average particle diameter is so small that the particles can be completely melted in the plasma flame during spraying. The high purity and generally spherical shape of particles ensures that a coating resulting from spraying thereof have a high bond strength and that the coating have a reduced surface roughness, typically of up to 60 $\mu$m.

In another embodiment, the invention provides a thermally sprayed component comprising a substrate and a coating of the rare earth oxide particles thermally sprayed to a surface of the substrate.

The material of the substrate is usually selected from metals, ceramics and glass, though not limited thereto. Examples of metal materials include Al, Fe, Si, Cr, Zn, Zr, Ni and alloys thereof. Examples of ceramics include metallic nitride, metallic carbide and metallic oxide such as alumina, aluminum nitride, silicon nitride and silicon carbide. Examples of glasses include quartz glass. Substrates of metals or alloys based on Al, Fe, Si or Ni are preferred since coatings are less adherent to ceramic and glass substrates.

The coating on the substrate surface preferably has a thickness of 50 to 500 μm, more preferably 150 to 300 μm. A coating thickness of less than 50 μm leads to a likelihood that the sprayed component, on use as a corrosion resistant component, must be replaced by a new one just after faint corrosion. A coating of more than 500 μm thick is too thick and has a risk that delamination occurs within it.

The coating preferably has a surface roughness of up to 60 μm, more preferably up to 20 μm. A surface roughness of more than 60 μm presents a larger plasma contact area which may degrade corrosion resistance and allow fines to generate with the progress of corrosion. Namely, a coating having a surface roughness of up to 60 μm ensures good corrosion resistance sufficient to preclude corrosion even in a corrosive gas atmosphere as typified by halide gas plasma. Then the sprayed component is advantageously used as a corrosion resistant component.

The spray coated component of the invention is obtainable by plasma or vacuum spraying the rare earth oxide particles to the substrate surface to form a coating thereon. The plasma gas used herein is usually selected from nitrogen/hydrogen, argon/hydrogen, argon/helium and argon/nitrogen, though not limited thereto. The spraying conditions are not critical and may be determined as appropriate in accordance with the type of substrate and rare earth oxide particles used and the desired application of the spray coated component.

In the spray coated component, the coating should preferably have a limited total content of iron group elements, alkali metal elements and alkaline earth metal elements which is up to 20 ppm. This level is accomplished using spray particles of rare earth oxide having a total metal element content of up to 20 ppm as described above. Differently stated, when coating is formed using spray particles of rare earth oxide having iron group elements, alkali metal elements and alkaline earth metal elements introduced at a total content of more than 20 ppm, the iron group elements, alkali metal elements and alkaline earth metal elements are incorporated in the coating in the same content as in the starting spray particles. The present invention eliminates this problem.

The sprayed component in which the coating has a total metal element content of up to 20 ppm causes least contamination and can be used in equipment where a high purity is crucial. More specifically, the sprayed component is best suited for use in liquid crystal manufacturing equipment and semiconductor manufacturing equipment, to name a few.

EXAMPLE

Examples of the invention are given below by way of illustration and not by way of limitation.

Example 1

While 30 liters of a yttrium nitrate solution (0.3 mol/1) cooled at 3° C. was agitated at 200 rpm, 30 liter of an oxalic acid solution (0.5 mol/1) was slowly added over about 5 minutes for reaction. The solution was aged for 10 minutes while keeping at 3° C. The resulting yttrium oxalate was collected by filtration, washed with water, and freeze dried for 30 hours. The yttrium oxalate was then fired in air at 1,500° C. for 2 hours, obtaining 990 g of yttrium oxide particles. The particles were measured for physical properties including particle diameter and crystallite size, with the results shown in Table 1. The yttrium oxide particles had a true density of 5.03 g/cm$^3$.

Using an argon/hydrogen gas plasma, the yttrium oxide particles were sprayed to an aluminum alloy (No. 6061 described in JIS H4000) substrate to form a coating of 210 μm thick thereon. The coating was examined for physical properties and corrosion resistance, with the results shown in Table 2. It is noted that surface roughness Ra was measured according to JIS B0601. Corrosion resistance was examined by a test of 24 hour exposure in $CF_4$ plasma using a reactive ion etching (RIE) equipment, and expressed by a percentage of the weight of the tested component based on the weight of the component prior to the test.

Example 2

The procedure of Example 1 was repeated except that erbium nitrate was used instead of yttrium nitrate, obtaining 1680 g of erbium oxide particles. Physical properties including particle diameter and crystallite size of the particles are shown in Table 1. The erbium oxide particles had a true density of 8.64 g/cm$^3$.

Using an argon/hydrogen gas plasma, the erbium oxide particles were sprayed to a silicon substrate to form a coating of 250 μm thick thereon. The coating was examined for physical properties and corrosion resistance, with the results shown in Table 2.

Comparative Example 1

In 15 liters of deionized water was dissolved 15 g of polyvinyl alcohol (PVA). 5 kg of yttrium oxide having an average particle diameter of 1.2 μm was dispersed therein to form a slurry. Using a nozzle spray granulator, the slurry was spray dried to form granules. They were fired at 1,600° C. for 2 hours, obtaining yttrium oxide particles for thermal spraying. Physical properties including particle diameter and crystallite size of the particles are shown in Table 1.

Using an argon/hydrogen gas plasma, the yttrium oxide particles were sprayed to an aluminum alloy substrate to form a coating of 250 μm thick thereon. The coating was examined for physical properties and corrosion resistance, with the results shown in Table 2.

TABLE 1

| | Particles | | |
|---|---|---|---|
| | Example 1 | Example 2 | Comparative Example 1 |
| Average particle diameter (μm) | 9 | 12 | 24 |
| Dispersion index | 0.23 | 0.29 | 0.49 |
| Aspect ratio | 1.1 | 1.1 | 1.1 |
| Bulk density/True density (%) | 42 | 46 | 26 |
| BET surface area (m$^2$/g) | 0.3 | 0.3 | 1.2 |
| Crystallite size (nm) | 50 | 60 | 20 |
| CaO (ppm) | <1 | <1 | 5 |
| $Fe_2O_3$ (ppm) | <1 | <1 | 8 |
| $Na_2O$ (ppm) | <1 | <1 | 11 |

TABLE 2

| | Coating | | |
|---|---|---|---|
| | Example 1 | Example 2 | Comparative Example 1 |
| Surface roughness ($\mu$m) | 16 | 30 | 73 |
| CaO (ppm) | <1 | <1 | 5 |
| $Fe_2O_3$ (ppm) | <1 | <1 | 8 |
| $Na_2O$ (ppm) | <1 | <1 | 11 |
| Corrosion resistance (%) | 99.91 | 99.94 | 99.86 |

As seen from Table 1, the rare earth oxide particles obtained in Examples 1 and 2 have an average particle diameter of less than 20 $\mu$m, a low dispersion index of less than 0.3, a high purity as demonstrated by very low impurity contents of CaO, $Fe_2O_3$ and $Na_2O$, and a high bulk density indicative of denseness. In contrast, the rare earth oxide particles obtained in Comparative Example 1 have a high dispersion index of 0.5, high impurity contents of $Fe_2O_3$, $Na_2O$, etc. and a low bulk density.

The coatings of sprayed rare earth oxide particles in Examples 1 and 2 have very low impurity contents of CaO, $Fe_2O_3$ and $Na_2O$, as seen from Table 2 and are thus suitable in the application where a high purity is required, for example, in liquid crystal manufacturing equipment and semiconductor manufacturing equipment. The sprayed component having a coating with a reduced surface roughness is useful as a corrosion resistant component for operation in a corrosive gas atmosphere such as halide gas plasma.

In contrast, the coating of sprayed particles in Comparative Example 1 has the impurity contents of CaO, $Fe_2O_3$ and $Na_2O$ unchanged from the spray particles and a high surface roughness of 73 $\mu$m, as seen from Table 2.

The rare earth oxide particles for thermal spraying having an average particle diameter of 3 to 20 $\mu$m, a dispersion index of up to 0.4, and an aspect ratio of up to 2 according to the invention can be consistently and continuously fed to the spray nozzle and completely melted in the plasma flame during the spraying to form a coating on a substrate so that the bond strength between the coating and the substrate may be increased.

Japanese Patent Application No. 2001-080154 is incorporated herein by reference.

Reasonable modifications and variations are possible from the foregoing disclosure without departing from either the spirit or scope of the present invention as defined by the claims.

What is claimed is:

1. Rare earth oxide particles for thermal spraying having an average particle diameter of 3 to 20 $\mu$m, a dispersion index of up to 0.4, and an aspect ratio of up to 2.

2. The rare earth oxide particles of claim 1 having a specific surface area of 0.3 to 1.0 $m^2$/ g.

3. The rare earth oxide particles of claim 1 having a bulk density of 30 to 50% of true density.

4. The rare earth oxide particles of claim 1 wherein crystallites have a size of at least 25 nm.

5. The rare earth oxide particles of claim 1 wherein a total amount of iron group elements, alkali metal elements and alkaline earth metal elements combined is up to 20 ppm.

6. A sprayed component comprising a substrate having a surface and a coating of the rare earth oxide particles of claim 1 thermally sprayed on the substrate surface.

7. The sprayed component of claim 6 wherein said substrate is made of a metal material selected from the group consisting of Al, Fe, Si, Cr, Zn, Zr, Ni and alloys thereof, or a ceramic or glass material.

8. The sprayed component of claim 6 wherein said coating has a surface roughness of up to 60 $\mu$m.

9. A corrosion resistant component comprising the sprayed component of claim 6.

10. The rare earth oxide particles of claim 1 having a specific surface area of 0.3 to 0.8 $m^2$/ g.

* * * * *